US007025519B2

(12) United States Patent
Geddes

(10) Patent No.: US 7,025,519 B2
(45) Date of Patent: Apr. 11, 2006

(54) UNIQUE WRITING INSTRUMENT

(75) Inventor: William Thomas Geddes, Cockeysville, MD (US)

(73) Assignee: Raymond Geddes & Company, Inc., Baltimore, MD (US)

( * ) Notice: Subject to any disclaimer, the term of this patent is extended or adjusted under 35 U.S.C. 154(b) by 0 days.

(21) Appl. No.: 11/052,602

(22) Filed: Feb. 7, 2005

(65) Prior Publication Data

US 2005/0158115 A1 Jul. 21, 2005

Related U.S. Application Data

(63) Continuation-in-part of application No. 10/283,438, filed on Oct. 30, 2002, now abandoned.

(51) Int. Cl.
*A46B 5/02* (2006.01)
*B43K 25/00* (2006.01)

(52) U.S. Cl. ..... 401/6; 401/195; 401/52

(58) Field of Classification Search ..... 401/6, 401/52, 195; 16/430
See application file for complete search history.

(56) References Cited

U.S. PATENT DOCUMENTS

| | | | | |
|---|---|---|---|---|
| D295,421 | S * | 4/1988 | Young | D19/43 |
| 5,352,120 | A * | 10/1994 | Hambright | 434/95 |
| 6,048,422 | A * | 4/2000 | Kim et al. | 156/73.6 |
| 6,217,245 | B1 * | 4/2001 | El-Fakir et al. | 401/195 |
| 6,461,067 | B1 * | 10/2002 | Beck et al. | 401/7 |
| 6,612,766 | B1 * | 9/2003 | Collins | 401/88 |

* cited by examiner

*Primary Examiner*—David J. Walczak
(74) *Attorney, Agent, or Firm*—Sterne, Kessler, Goldstein & Fox P.L.L.C.

(57) ABSTRACT

A unique writing instrument. The writing instrument comprises a barrel, which has an initial first layer of an adhesive onto which solid beads are adhered, said beads forming a textured grip facilitating a user in holding the article.

10 Claims, 3 Drawing Sheets

*Bead covered pencil*

*Bead covered pencil*

*Bead covered ball point pen*

UNIQUE WRITING INSTRUMENT

This is a continuation in part of the patent application Ser. No. 10/283,438 filed Oct. 30, 2002 now abandon.

FIELD OF THE INVENTION

The present invention relates to a writing instrument. In particular, the present invention relates to an article that comprises a decorative barrel, and the method of making the decorative barrel. More particularly, the present invention is related to a writing instrument comprising a wooden, plastic or acrylic type barrel onto which a first layer of an adhesive is applied, and onto which numerous preformed or pre-existing tiny balls or beads of glass, plastic, foam or other solid substance are then applied either sporadically or consistently across or around the barrel. The beads may also be contained within a transparent plastic or acrylic barrel. The applied beads protrude from the surface of the instrument forming a textured or raised surface. For beads contained within the barrel of the instrument, the surface of the instrument is smooth, with the beads visible within the body of the barrel. Multicolored beads or beads arranged in a particular sequence can be incorporated onto the barrel of the instrument to form patterns or designs. A method of making said article is also described.

BACKGROUND OF THE INVENTION

The present invention describes a writing instrument with a cylindrical or octagonal barrel to which a first layer of an adhesive is applied which secures the small glass, plastic, resin or foam beads, 0.1 mm or less in diameter, to the barrel. Alternatively, beads can be mixed into a clear plastic or acrylic substance which is formed into a cylindrical barrel through which the beads are visible, said barrel also housing the writing instrument This invention presents a novel approach to creating decorative writing instrument barrels while providing a necessary writing function.

Presently there are a variety of textured writing instruments. For instance, U.S. Pat. No. 6,461,067 (Beck et al) describes a writing instrument wherein small knobs or lumps called nubs are formed by applying to the writing Instrument an initially flowable plastic composition that later solidifies to form the raised structures. This is distinctly different from using preformed or pre-existing beads, which inter alia facilitate gripping of the writing instrument by its user.

Some writing instruments, such as described in U.S. Pat. No. 6,217,245 (El-Fakir et al), are manufactured by application of three layers of materials, the first layer being that of a base coat of a dark colorant and wherein glitter particles made of iridescent mylar are used to provide a frosted appearance. The present invention is distinctly different in as much as neither a fist coat of a dark colorant nor glitters are used. In general many, if not most, of these prior art items require either a molded plastic surface which is uniform through the production of the instrument or a removable textured grip to achieve the desired textured surface. The textured surface assists a user in gripping the instrument. In addition, from an aesthetic standpoint conventional writing instruments usually carry designs through painting or paper wraps adhered to the barrel, without which the instruments cannot offer colorful designs for the instrument. These prior art designs, such as a painted finish or a smooth wrap generally do not assist the user in gripping the invention. The present invention offers a novel design and approach to alleviating such problems, which the available writing instruments do not offer.

Accordingly, there is a need for providing a writing instrument with a random or uniform textured surface through the adhesion of tiny glass, plastic, resin or foam (such as polystyrene) beads to the barrel of the instrument There is an additional need to provide a writing instrument with a reduced diameter barrel such that once the layer of adhesive is applied to the beads, the instrument will maintain the diameter of a conventional writing instrument. This will permit sharpening, in the case of a pencil, in a conventional pencil sharpener.

There is an additional need for an instrument which comprises beads applied to the surface of a writing instrument in a random fashion or uniformly encircling the barrel of the instrument The beads may be of the same color or of different colors. The colored beads may be arranged in specified pattern such as a stripe or other decorative pattern or design.

There is also a need for an instrument with a clear and transparent plastic or acrylic barrel which contains decorative beads within the transparent barrel In addition, there is a need to provide a writing instrument with a novel design, that is pleasing to use and easy to manufacture.

SUMMARY OF THE INVENTION

Accordingly, it is an advantage of the present invention to meet these and other needs through preparing a writing instrument with small beads (0.1 mm or less in diameter) either adhered on the outer surface of the barrel of the instrument, such as on a pencil, or contained within the barrel, such as a bead filled ball point pen with transparent barrel.

It is another object of the invention to provide a writing instrument that provides a uniform or random application of the beads to the instrument.

It is still another object of the invention to provide a writing instrument with a textured barrel through the application of decorative beads to the barrel of the instrument.

Another advantage of the invention is to provide a writing instrument with a textured barrel which assists the user with gripping the instrument.

It is yet another object of the invention to provide a writing instrument with a stylized barrel with patterns or figures depicted on the barrel through the use of similarly or differently colored beads.

It is still another object of the invention to provide a writing instrument with the beaded barrel, which after the application of the beads to the barrel, maintains the standard range of diameter for a writing instrument and thus can be sharpened in a conventional sharpener.

Another advantage of the present invention is that clear or translucent beads could be used to permit the color of the instrument to be seen through the beads.

Another object of the invention is to provide a writing instrument with a clear plastic or acrylic barrel containing decorative beads embedded within.

It is yet another object of the invention to provide a writing instrument that is simple in construction, low in cost, lightweight and easy to manufacture.

To achieve the stated and other advantages of the present invention, as embodied and described below, the invention includes a writing instrument, comprising wooden or plastic barrel with a reduced diameter, the application of a single layer of glass, resin or plastic beads to the barrel in a uniform or random application creating a raised grip area along the barrel of the instrument said application being of adjustable or adaptable designs, shapes, sizes and configurations, and a writing instrument with a clear plastic or acrylic barrel with decorative beads embedded within the clear barrel.

Additional advantages and novel features of the invention will be set forth in part in the description that follows, and in part will become more apparent to those skilled in the art upon examination of the following description of the drawings or upon learning by practice of the invention.

BRIEF DESCRIPTION OF THE DRAWINGS

References will now be made in detail to embodiments of the present invention, examples of which are illustrative in the accompanying drawings.

FIG. 2 also demonstrates the invention in the grip area of the pen as well as a decorative design on the opposite end of the writing instrument from the writing point.

DETAILED DESCRIPTION OF THE INVENTION

The invention includes a writing instrument with a decorative and functional barrel. This invention includes a coating of small beads made of glass, plastic or resin which is applied to the barrel of a writing instrument which may be applied in a uniform consistent fashion, in random fashion or pattern, or in striped fashion and the like. The beads may be colored, opaque, translucent or clear and may be colored in any fashion. Preferred are small beads, about 0.1 mm or smaller in diameter. The beads are applied to the instrument after a first layer of thin coating of adhesive is applied to the barrel, said thin layer of adhesive may be applied without an initial layer of a base coat of a colorant. After said adhesive is applied, the beads are delivered to the adhesive-covered barrel creating a raised texture on the barrel.

Figure 2:
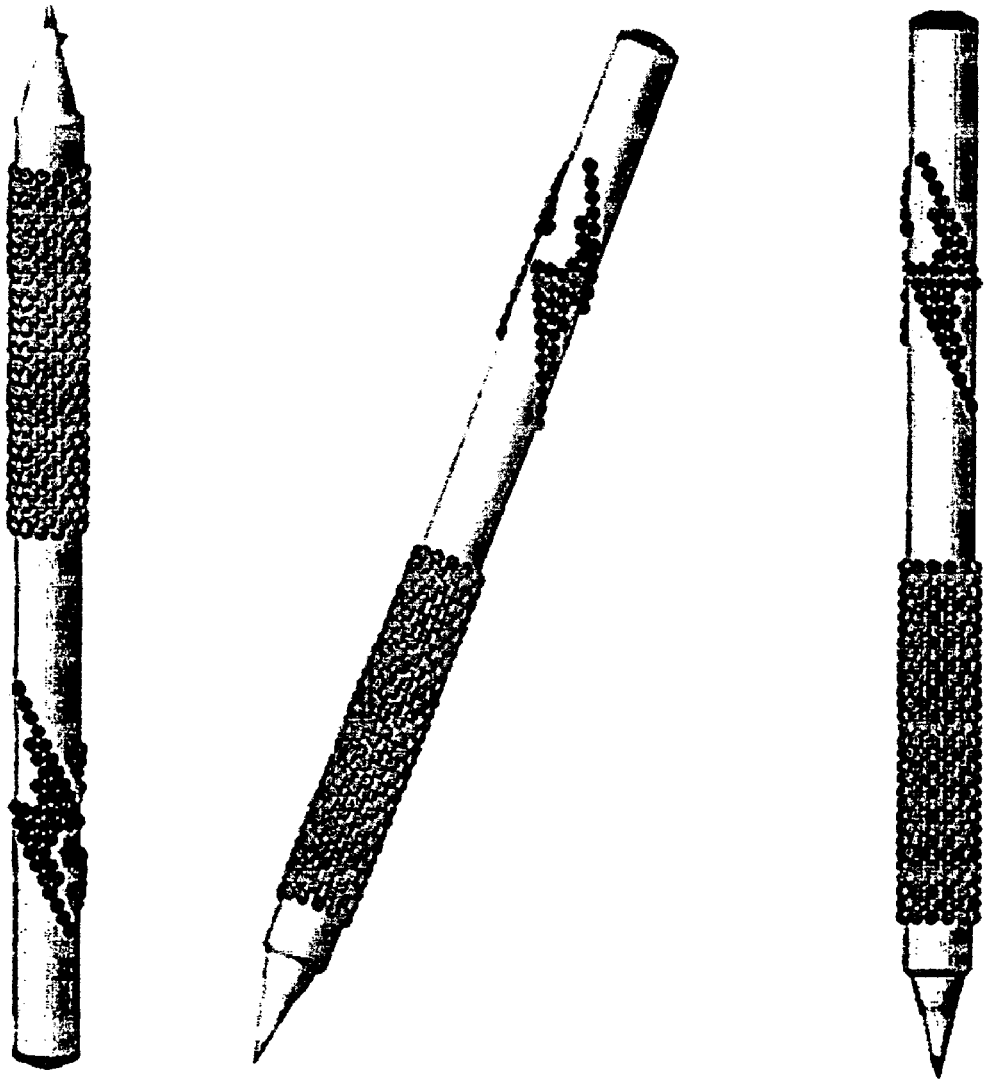
FIG. 2 illustrates several applications of decorative beads to the barrel of a ball point pen.

The beads may completely cover the surface of the barrel which may be achieved by rolling the adhesive covered instrument in a container of the desired colored beads. The beads may be arranged in particular shapes and patterns either through different colored beads arranged in a pattern or a limited application of beads to a particular area of the instrument as shown in FIG. 2.

The presence of the beads upon the barrel creates a texture on the barrel of the instrument which facilitates gripping the instrument. In addition, the barrel of the instrument would be reduced in diameter to compensate for the thin layer of adhesive and beads, such that after application of the adhesive and beads the diameter of the instrument is consistent with similar instrument currently available for sale on the market In the case of a pencil, the diameter of the invention should be consistent with conventional pencils (approximately 7 mm) such that the writing instrument of the present invention could be sharpened in a conventional sharpener.

The invention may apply to a standard wooden pencil and a variety of other writing instruments such as ball point pens, gel ink pens, crayons, colored pencils and the like. The beads may be translucent or transparently clear such that the color coating of the barrel may be visible through the beads. In addition, the beads themselves may be covered in a clear material to give the impression of the beads floating within the material. Contrary to the textured surface obtained when the beads are applied to the surface of the instrument by an adhesive, the barrel of the instrument would be smooth if the beads were encased or embedded within the barrel made of clear acrylic material. See FIG. 3.

It should be understood that unless defined otherwise, all technical and scientific terms used herein have the same meaning as commonly understood by one of ordinary skill in the art to which this invention belongs. Although any methods and materials similar or equivalent to those described herein can be used in the practice or testing of the present invention, the methods and materials described herein are used in the practice or testing of the present invention, the methods and materials described herein are preferred. Unless mentioned otherwise, the techniques employed or contemplated herein are standard methodologies well known to one of ordinary skill in the art. The materials, methods and examples are only exemplary and not limiting.

The term "bead" as used herein refers to any preformed or pre-existing material, other than glitters, of circular, elliptical, oblong or other geometric shape. The diameter of the beads may be about 0.1 mm or less. And, the term "textured" as used herein means that the "beads" form said textured grip.

Figure 1:
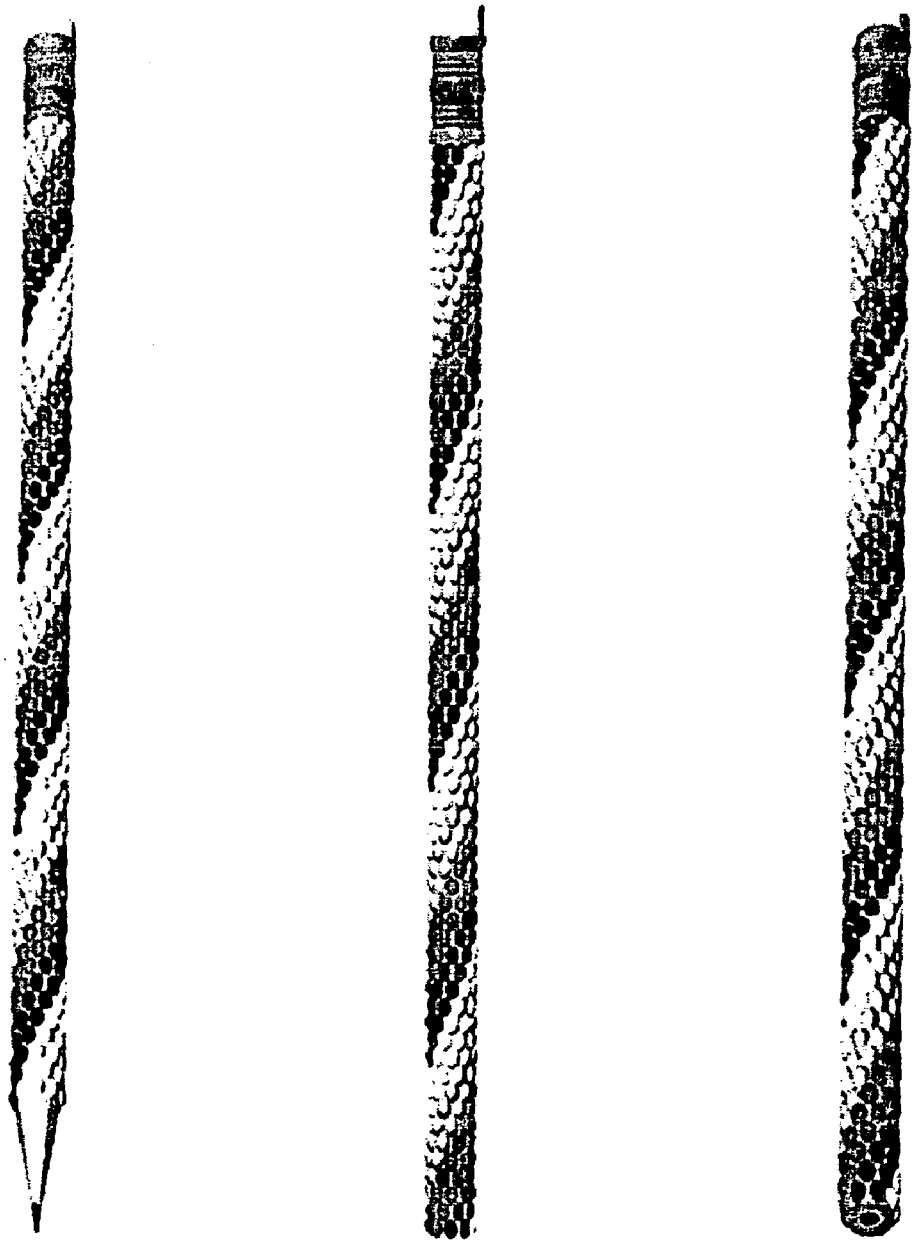
FIG. 1 depicts the invention as it applies to a wooden pencil.

FIG. 1 illustrates the invention as it is applied to a wooden pencil barrel. The pencil barrel is reduced in size to accommodate the adhesive and bead application. FIG. 1 illustrates the application of beads to the barrel of a wooden pencil with a pattern to the beads. The beads can be applied to a ball point pen or other writing instrument in the manner shown in FIG. 1.

Figure 3:
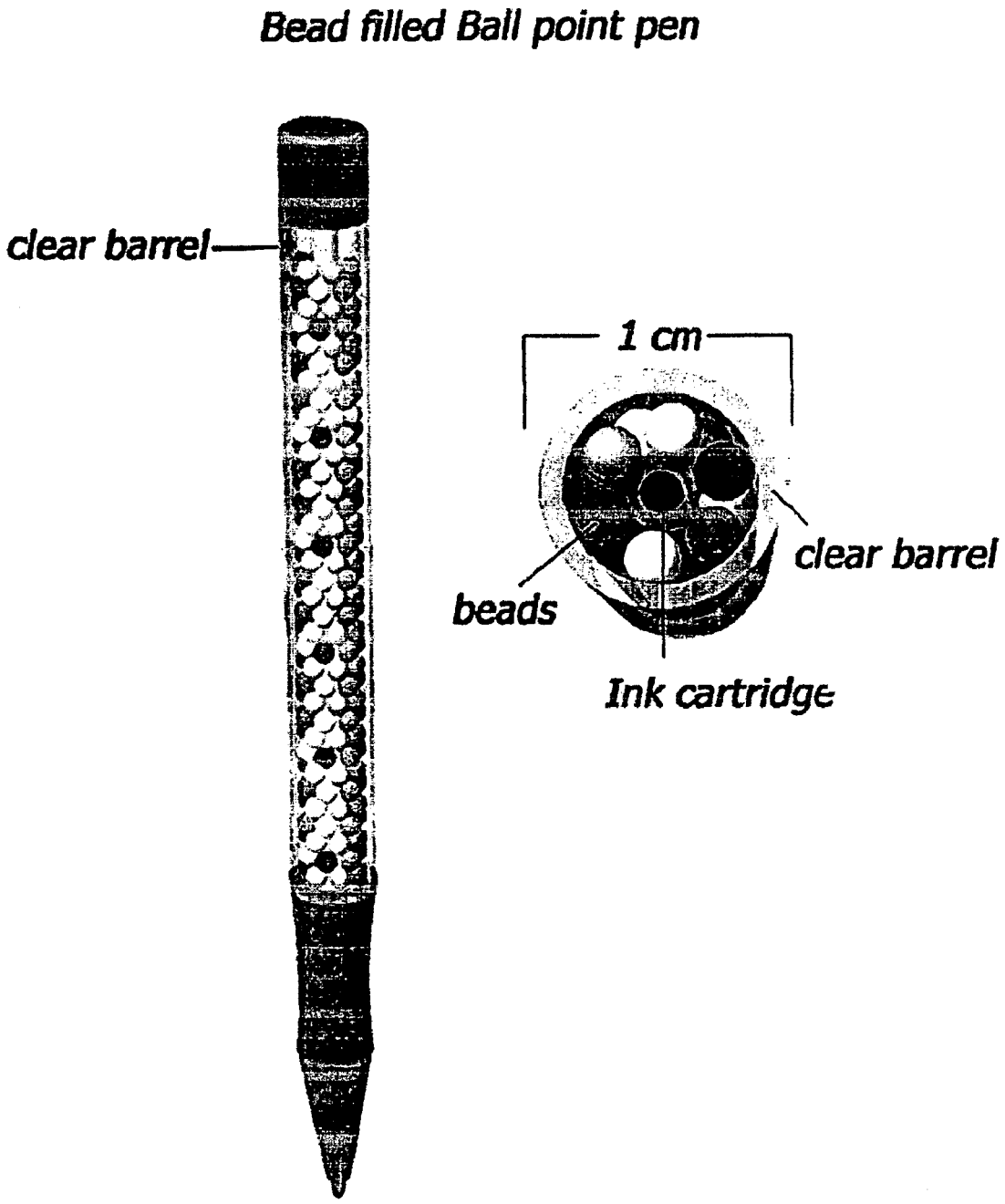
FIG. 3 illustrates the invention as it is applied to a clear acrylic barrel with decorative beads embedded within.

FIG. 3 illustrates the invention as it may be applied to an acrylic or clear plastic writing instrument such as a ball point pen. The beads would be distributed within the barrel casing and would be visible through the clear casing as depicted in FIG. 3.

In a preferred embodiment of the invention, the device comprises a wooden barrel with a diameter of about 6.8 mm to which a first thin layer of adhesive is applied and upon which a layer of small (less than 0.1 mm in diameter), glass, plastic, foam or resin beads are applied. Upon completion of the adhesive curing process, the overall pencil diameter would not exceed that of conventional pencils such that the pencil with the beaded barrel would sharpen in a conventional sharpener.

In another embodiment of the invention, the article comprises a writing instrument with a clear acrylic barrel containing decorative beads within the body of the barrel.

A method of making a writing instrument with a decorative barrel, comprises the following steps:

(i) applying adhesive by submersing the instrument into a container of adhesive or by spaying the adhesive to the barrel;

(ii) allowing the adhesive to set in order to accept the beads;

(iii) applying the beads to the adhesive of step (ii) by spraying or dipping the barrel into a container of beads or manually applying the beads if a particular pattern is desired;

(iv) removing any decorative beads that did not property adhere to the barrel;

(v) reapplying beads that failed to properly adhere to the barrel, if required;

(vi) verifying desired coverage or pattern creation of beads;

(vii) curing the adhesive to create an adhesive bond; and then (viii) checking the quality of article assembly and packaging.

A method for manufacturing an article including a writing instrument with a barrel wherein decorative beads are embedded within the barrel of the instrument., comprises the steps of:

(i) melting an acrylic or plastic material to achieve liquid consistency;

(ii) mixing decorative beads into molten material of step (i);

(iii) injecting the molten material containing the decorative beads into a desired mold to form a barrel for a writing instrument;

(iv) allowing the mold to cool;

(v) checking the quality of the product and assuring a smooth finish.;

(vi) assembling writing instrument components; and then (vii) checking the quality of assembly and packaging.

Of course, having learnt the teachings of the present invention, one skilled in the art may vary the manufacturing process in different ways to meet the objectives of the present invention.

Example embodiments of the present invention have now been described in accordance with the above advantages. It will be appreciated that these examples are merely illustrative of the invention and not limitations thereof. Many variations and modifications will be apparent to those skilled in the art and all such modifications and variations are included within the purview and scope of the appended claims.

What is claimed is:

1. An article, comprising a writing instrument with a barrel on to which an initial first layer of an adhesive is applied and onto said adhesive solid spherical balls are adhered, said balls substantially covering a portion of said barrel to form a textured grip facilitating a user in holding the article.

2. The article of claim 1, wherein said balls are of less than 0.1 mm in diameter.

3. The article of claim 2 wherein said balls are multicolored and made of glass, plastic, resin or foam.

4. The article of claim 3, wherein said barrel is a wooden pencil barrel or a ball point pen.

5. The article of claim 4, wherein the balls are applied to adhere consistently along and around the barrel of the writing instrument.

6. The article of claim 4, wherein the balls are applied to adhere in a random manner about the barrel of the instrument.

7. The article of claim 4, wherein the balls are applied to adhere in a design, pattern or decorative shape along the barrel of the instrument.

8. An article, comprising a writing instrument with a barrel on to which an initial first layer of an adhesive is applied and onto said adhesive solid spherical balls are adhered in a random manner around the barrel of the writing instrument, said balls substantially covering a portion of said barrel to form a textured surface enabling a user in gripping the article.

9. The article of claim 8, wherein said solid balls are of less than 0.1 mm in diameter and applied to adhere in a design pattern or decorative shape along or about the barrel of the instrument.

10. The article of claim 9, wherein said barrel has a diameter of reduced size so that after application of said layer of an adhesive and the balls, the diameter of the instrument is of conventional size of about 7 cm.

* * * * *

UNITED STATES PATENT AND TRADEMARK OFFICE

CERTIFICATE OF CORRECTION

PATENT NO. : 7,025,519 B2
APPLICATION NO. : 11/052602
DATED : April 11, 2006
INVENTOR(S) : William Thomas Geddes It is certified that error appears in the above-identified patent and that said Letters Patent is hereby corrected as shown below:

Claim 10, column 6, line 34, reading “7cm” should read --7mm--.

Signed and Sealed this

Twenty-second Day of August, 2006

JON W. DUDAS
*Director of the United States Patent and Trademark Office*